US006209475B1

(12) United States Patent
Powell

(10) Patent No.: US 6,209,475 B1
(45) Date of Patent: Apr. 3, 2001

(54) ANCHOR CONNECTION

(76) Inventor: Peter Geoffrey Powell, 24 Universal Close, White Rock, Queensland 4868 (AU)

( * ) Notice: Subject to any disclaimer, the term of this patent is extended or adjusted under 35 U.S.C. 154(b) by 0 days.

(21) Appl. No.: 09/414,492

(22) Filed: Oct. 8, 1999

(30) Foreign Application Priority Data

Oct. 8, 1998 (AU) ..... PP6398

(51) Int. Cl.[7] ..... B63B 21/46
(52) U.S. Cl. ..... 114/299
(58) Field of Search ..... 114/297, 298, 114/299

(56) References Cited

U.S. PATENT DOCUMENTS

| | | | |
|---|---|---|---|
| 3,995,577 | 12/1976 | Gentry | 114/206 R |
| 4,836,126 | 6/1989 | Kobayashi | 114/297 |
| 4,987,847 | 1/1991 | Kobayashi | 114/297 |
| 5,074,235 | 12/1991 | Kobayashi | 114/295 |
| 5,207,775 | 5/1993 | Piton et al. | 114/295 |

FOREIGN PATENT DOCUMENTS

| | | | |
|---|---|---|---|
| 604437 | 12/1988 | (AU) . | |
| 629507 | 8/1991 | (AU) . | |
| 649127 | 3/1993 | (AU) . | |
| 1-190597 * | 7/1989 | (JP) | 114/297 |
| 224672 | 10/1989 | (NZ) . | |
| 237058 | 2/1993 | (NZ) . | |

OTHER PUBLICATIONS

United Kingdom Search Report Jan. 14, 2000 Examainer: Richard Collins.
New Zealand Search Report Jan. 25, 2000 Neville Harris, Commissioner.

* cited by examiner

*Primary Examiner*—Sherman Basinger
(74) *Attorney, Agent, or Firm*—Hoffman Wasson & Gitler PC

(57) ABSTRACT

An anchor connection and retrieving device is disclosed. The device is adapted to be interposed between an anchor and one end of an anchor line, the anchor has a shank, a crown and a plurality of tynes or flukes. The device has a locking assembly including a releasable portion, a locking portion relative to which the releasable portion is releasably coupled. One or more release members are movable between a first position which couples the releasable portion to the locking portion and a second position which decouples the releasable portion from the locking portion. The locking portion is connected to the one end of the anchor line and a retrieving line is connected to it and the crown of the anchor. The releasable portion is coupled to the shank of the anchor. A release block may move along the anchor line to engage the release members to decouple the releasable portion from the locking portion.

24 Claims, 8 Drawing Sheets

ANCHOR CONNECTION

THIS INVENTION relates to an improved anchor connection and in particular, to an anchor retrieving device adapted to be positioned between an anchor and one end of a main anchoring line to retrieve the anchor when it becomes snagged at the bottom of a body of water.

When an anchor becomes snagged on rocks, coral, debris or the like, it is impossible to raise the anchor. The anchor chain or rope must then be cut and the anchor jettisoned. Alternatively, a diver may manually free the anchor but that is only possible where conditions are suitable and the depth of the anchor is not too great.

SUMMARY OF THE INVENTION

It is an object of the present invention to provide an improved anchor connection or an anchor retrieving device which at least minimises the disadvantage referred to above.

According to one aspect of the invention, there is provided an anchor connection and retrieving device adapted to be interposed between an anchor and one end of a main anchor line, the anchor having a shank, a crown and a plurality of tynes or flukes, the device having a locking assembly including a releasable portion, a locking portion relative to which the releasable portion is releasably coupled, a release member movable laterally between a first position allowing the releasable portion to be coupled to the locking portion and a second position in which the releasable portion may decouple from the locking portion, the locking portion being connected to the one end of the anchor line and a retrieving line connected to the locking portion and to the crown of the anchor, the releasable portion being coupled to the shank of the anchor, and a release block adapted for travel along the anchor line and for directly engaging the release member to move the release member laterally into the lock portion to allow the releasable portion to decouple from the locking portion.

According to one aspect the invention provides an anchor connection and retrieving device adapted to be interposed between an anchor and one end of a main anchor line, the anchor having a shank, a crown and tynes or flukes, the device having a locking assembly including a releasable portion, a locking portion relative to which the releasable portion is releasably coupled, two release members movable laterally between a first position allowing the releasable portion to be coupled to the locking portion and a second position in which the releasable portion may decouple from the locking portion whereby both said release members need to be moved to the second position before the releasable portion can be decoupled from the locking portion.

The release block may comprise a sleeve of suitable weight adapted to engage about the anchor line so that it may travel along the anchor line. The block may have a passage extending through it through which the anchor line may pass as the block travels along the line. The block may have an enlarged mouth at a leading end. Preferably, the enlarged mouth is provided by a flared opening.

The release block may consist of two parts hinged to each other which may be locked together to form a sleeve through which the anchor line may travel, the parts may be unlocked to allow the block to be positioned about the anchor line and then the parts may be locked together with the anchor line captured between them.

The locking portion may have a recess for receiving the releasable portion. The locking portion may consist of a sleeve within which the releasable portion may be received.

The releasable member may comprise a pin normally projecting outwardly of the locking portion. Preferably, the pin extends laterally of the locking portion.

BRIEF DESCRIPTION OF THE DRAWINGS

A particular preferred embodiment of the invention will now be described by way of example with reference to the drawings in which.

DETAILED DESCRIPTION OF THE PREFERRED EMBODIMENTS

Figure 1:
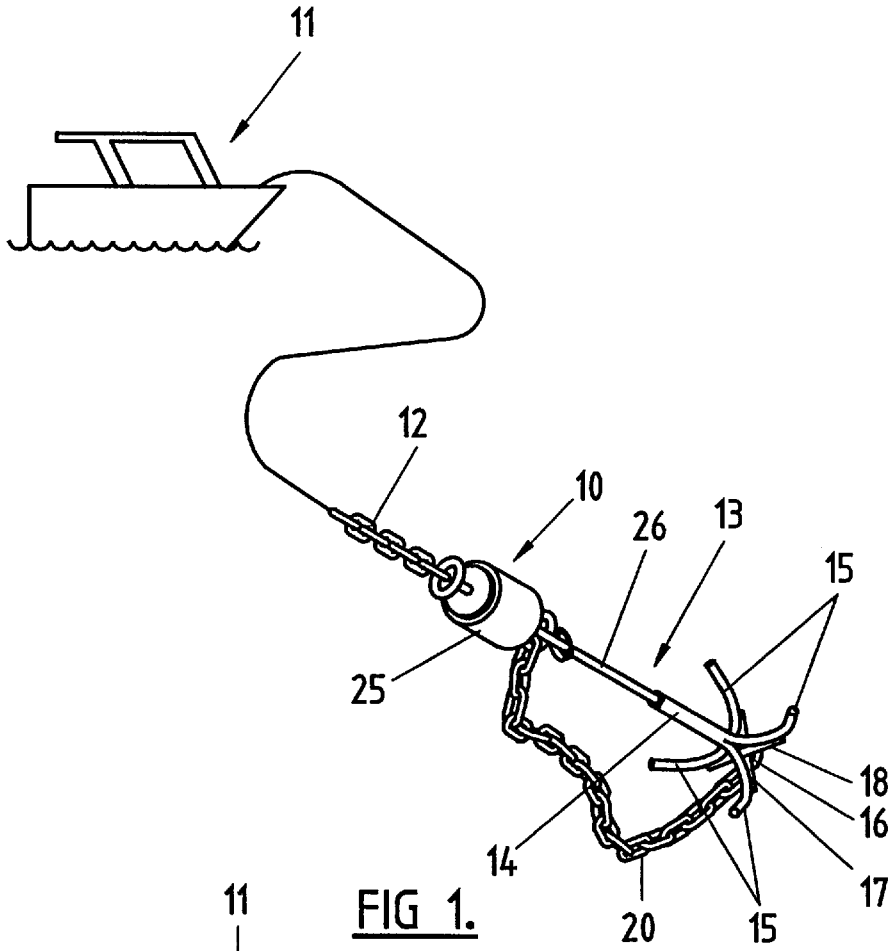
FIG. 1 shows the anchor retrieving device according to an embodiment of the invention with the device in its normal position.

In FIG. 1, an anchor connection or anchor retrieving device 10 is shown. A boat 11 has a main anchor line or chain 12 extending from it and having an end connected to device 10. The anchor 13 has a shank 14 and a plurality of tynes 15. In this embodiment, the crown 16 of the anchor is provided by bars 17, 18 and an end of a retrieval line or chain 20 is connected to the bars 17, 18. If desired, bars 17, 18 may be omitted and an end of the line or chain 20 may be connected to the tynes at the location where they diverge from the shank 14.

Locking assembly 25 is coupled between one end of the line or chain 12 and the retrieval line or chain 20. The retrieval chain 20 is of a length greater than the distance between the crown 16 of the anchor and the normal position assumed by the locking assembly 25 when it is in the position shown in FIG. 1.

The shank 14 has a link 26 coupled to it and one end of the link is connected to the assembly 25.

When the anchor is used to tether the boat 11, the device appears as shown in FIG. 1. To retrieve the anchor when the anchor is not snagged, chain 12 is hauled on board the boat and link 26 acts to lift the anchor from the floor of the body of water. Even when the anchor is not snagged, block 30 may be used in the manner described in the following paragraph.

If the anchor is snagged or even if it is not snagged, release block 30 which may either be a unitary sleeve or which consists of two halves hinged relates to each other and with the halves lockable to each other is allowed to travel down along the chain 12 under the influence of gravity until it passes over and against the lock assembly.

Figure 2:
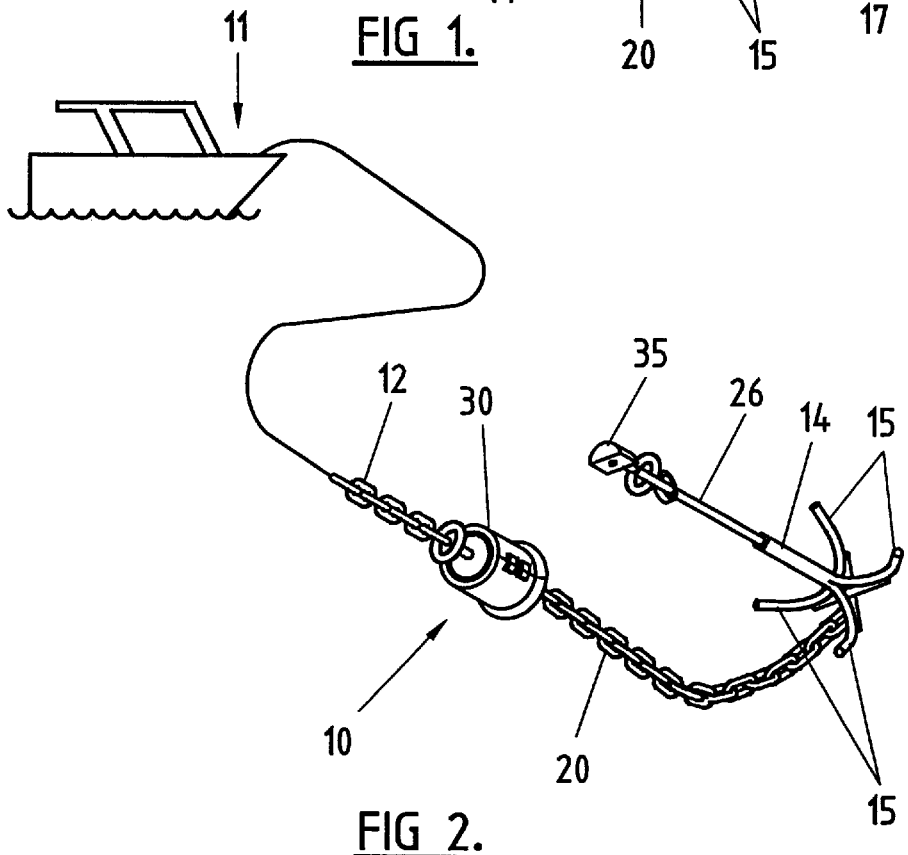
FIG. 2 shows the device of FIG. 1 with the device in its release position.

The block then acts upon the lock assembly to allow the releasable portion 35 to separate from the remainder of the lock assembly and the configuration shown in FIG. 2 is then achieved. When in this configuration, retrieval of the chain 12 onto the boat 11 now results in the anchor being lifted via chain 20 attached to the crown 16 and not via the shank 14. This action results in unsnagging of the anchor if the anchor Is snagged.

Once the anchor 13 is back on board, the boat 11 releasable portion 35 may then be recoupled to the remainder of the lock assembly 25.

Figure 3:
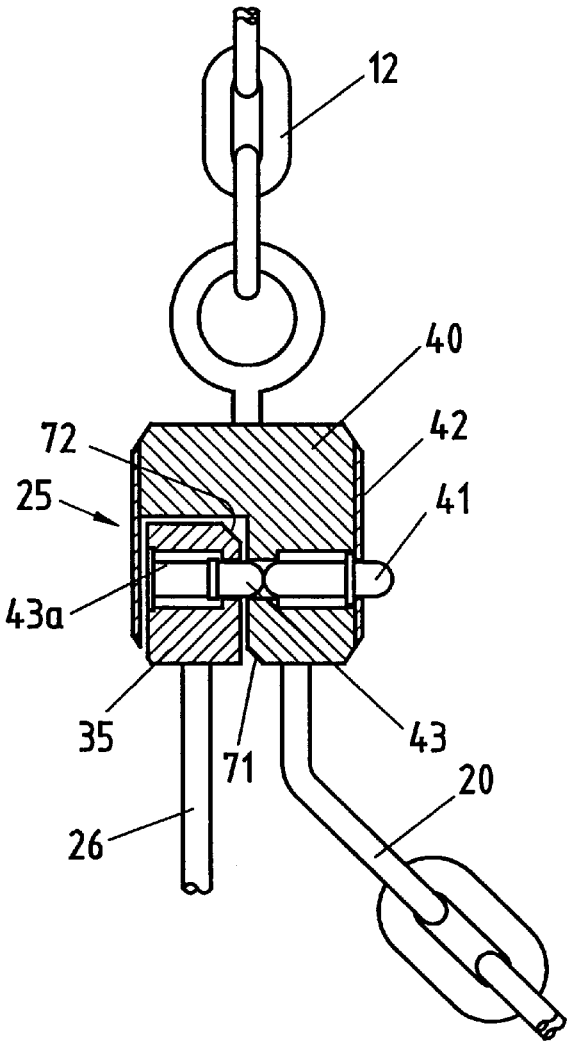
FIG. 3 shows detail of the device in its normal position.

FIG. 3 shows greater detail of the assembly 25. The assembly has a locking portion 40 coupled between main anchor line or chain 12 and the release line or chain 20. Portion 40 has a release member in the form of a pin 41 normally biased into the position shown extending outwardly of the portion 40. Portion 40 has a tapered shoulder 71 and portion 35 has a shoulder 72 and shoulder 72 functions to drive the pin 41 into its FIG. 3 position when the portion 35 is coupled to the locking portion 40. A sleeve 42 extends about the portion 40 and the pin extends through an aperture in the sleeve.

Releasable portion 35 is received in a recess defined between the sleeve 42 and the portion 40. Portion 35 has a pin 43 biased by a spring 43a and the pin 43 normally locates within the passage which receives pin 41 and pin 43 serves to retain the releasable portion 35 coupled to portion 40.

Figure 4:
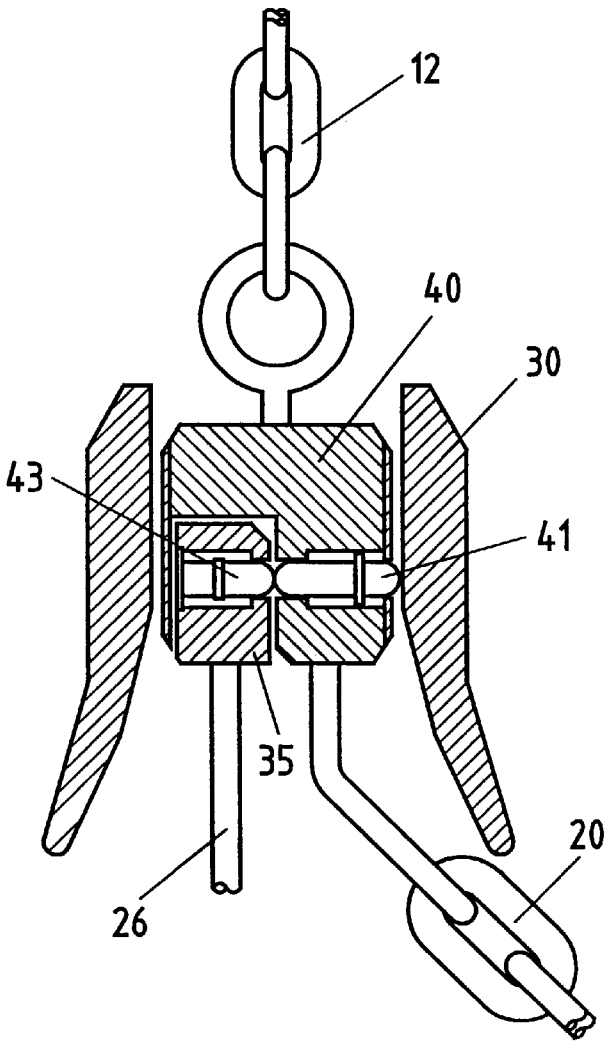
FIG. 4 shows the device in its release position.

FIG. 4 shows detail of the release block 30. Block 30 is tubular and has a flared leading end 50. The block 30 moves down along chain 12 under the influence of gravity and depresses pin 41. This causes pin 41 to depress pin 43 and then releasable portion 35 is then decoupled from the remainder of the assembly.

The release block 30 engages over the lock assembly and positively decouples the releasable member. The device may then be used to unsnag the anchor and the anchor may then be retrieved.

The device may readily be assembled by reinserting the releasable portion into the recess in the remainder of the lock assembly. The device allows the anchor to be retrieved by lifting the anchor from the crown. The anchor therefor is unlikely to damage reef growth.

Figure 5:
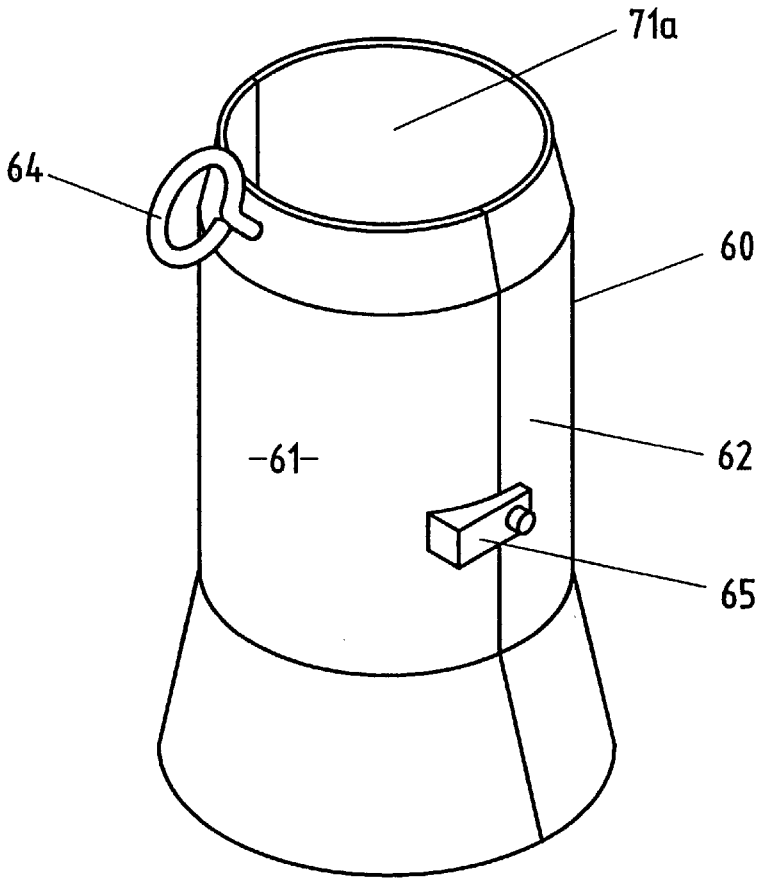
FIG. 5 is a perspective view of a release block according to another embodiment of the invention.
Figure 6:
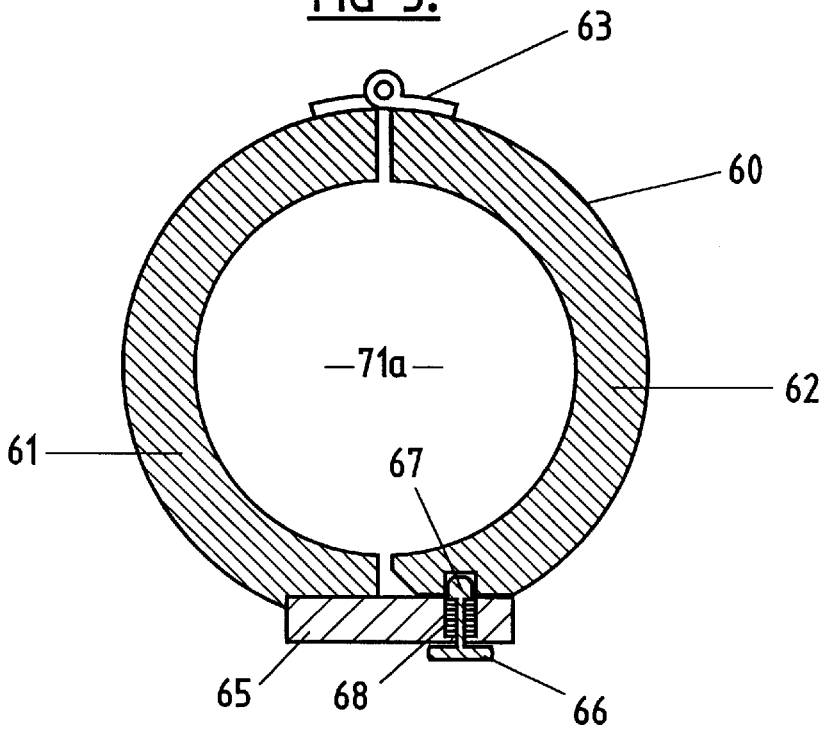
FIG. 6 is a transverse sectional view through the block of FIG. 5.

The release block 60 of FIGS. 5 and 6 is made of two halves 61, 62 secured to each other by a hinge 63. Of course, the block may be made as one piece if desired. Hook 64 is fixed to the block and allows the block to be tethered to prevent it from moving down the anchor chain or rope and contacting the locking portion 70 of the anchor retrieving/connection device of FIGS. 7 and 8. The hook may be omitted if desired.

The two halves 61, 62 are fixed to each other in the closed position shown in FIG. 5 by a catch having an arm 65 and a spring biased release pin 66. One end of the pin 66 is received in an aperture 67 in half 62 and is biased into that aperture by spring 68.

The halves 61 and 62 may be opened up to allow the block to be located extending around an anchor chain or rope and the halves may then be brought into the closed position of FIG. 5 with the chain/rope extending through passage 71*a*.

The chain 12 in FIG. 3 would normally be secured to a boat (not shown) and chain 26 is secured to a shank of an anchor. Chain 20 is coupled to the crown of an anchor.

Figure 7:
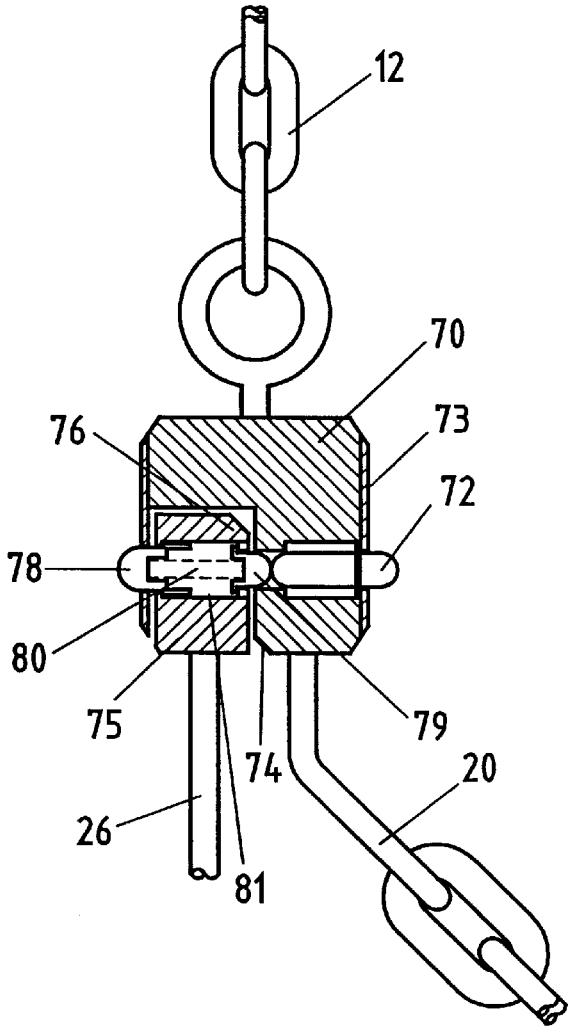
FIG. 7 shows detail of an anchor retrieving/connection device of another embodiment of the invention.

The locking portion 70 has a first release member 72 in the form a pin normally biased into the position shown in FIG. 7 where it projects beyond outer casing 73 of the locking portion. The portion 70 has a tapered shoulder 74 and release portion 75 also has a tapered shoulder 76. Shoulder 76 functions to drive pin 72 into its FIG. 7 position when the release portion 75 is coupled to the locking portion 70.

Pin 72 is received in a passage 77 and is movable along that passage.

Release portion 75 has a release member in the form of a pin with two parts 78, 79 biased away from one another by a spring 80. Part 79 contacts one end of pin 72 and causes the pin 72 to be biased outwardly of the locking portion 70.

Parts 78 and 79 are retained within passage 81 extending through release portion 75.

Figure 8:
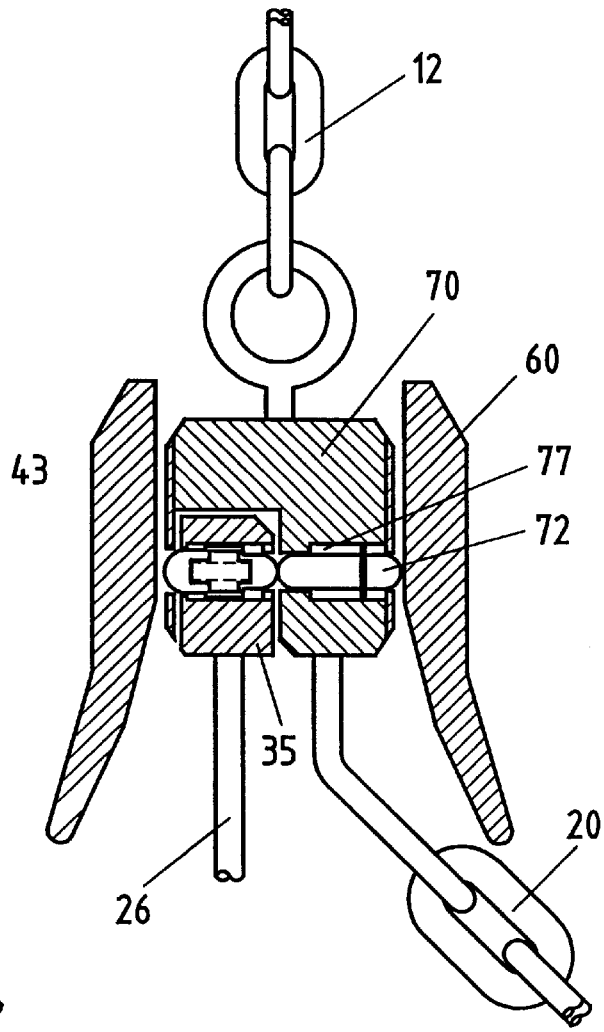
FIG. 8 shows a view of the device of FIG. 7 in its release position.

In order to separate portion 75 from the locking portion 70, part 78 and pin 72 must be driven into the passage 81 and 77 respectively as shown in FIG. 8. If only one of part 78 or pin 72 is retracted then portion 75 will not separate from locking portion 70. In this way the possibility of inadvertent release of portion 75 is unlikely to occur.

Figure 9:
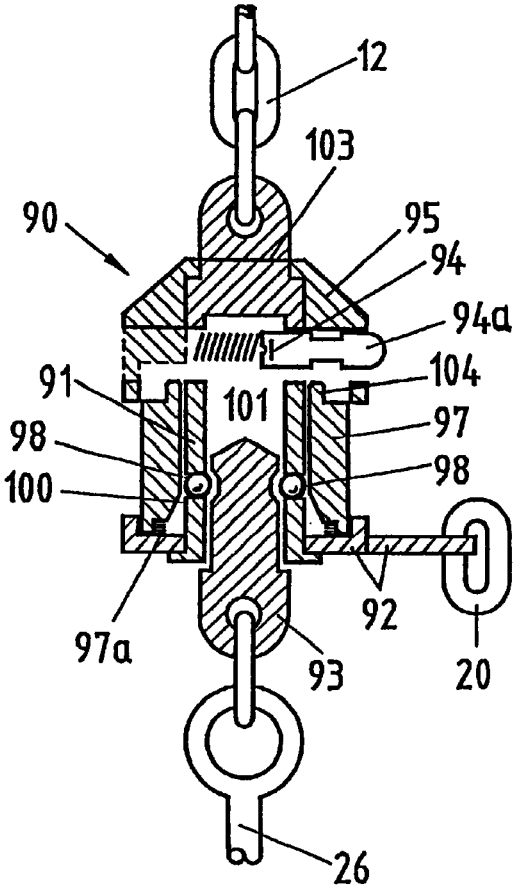
FIG. 9 shows detail of an anchor retrieving/connection device according to another embodiment of the invention.
Figure 10:
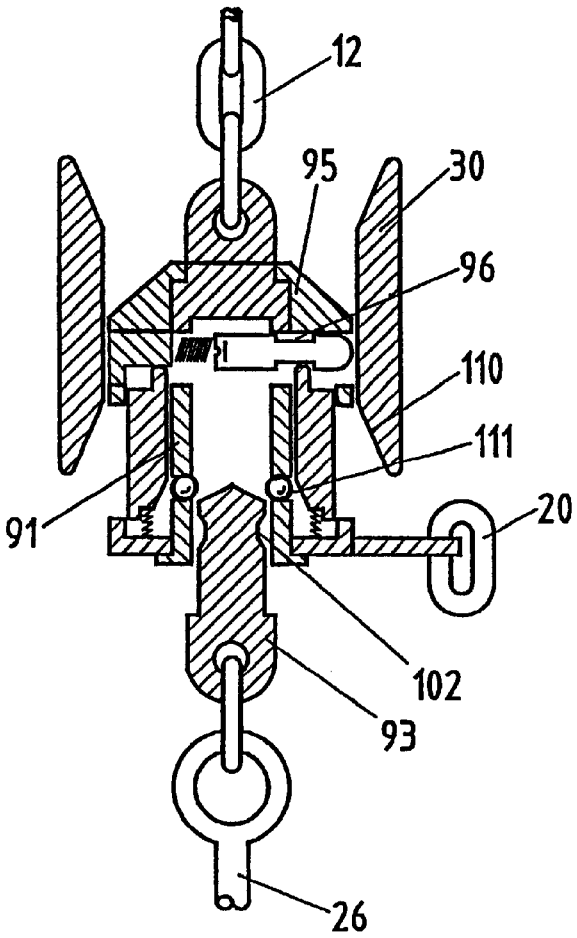
FIG. 10 shows a view of the device of FIG. 9 in its release position.

In FIGS. 9 and 10 alternative device 90 is shown. The device has a locking portion 91 coupled between a main anchor line or chain 12 and a release line or chain 20 is coupled to a stop plate 92. Releasable portion 93 has a link 26 coupled to it which is connected to the shank of an anchor. Locking portion 91 and retaining sleeve 95 has 2 or 3 release pins spaced radially around it and these pins are biased into the position shown in FIG. 9 by springs shown in the configuration.

A locking sleeve 97 extends around the locking portion 91 and encases locking balls 98. These balls are located in passages 100 in the portion 91. These passages have a reduced diameter opening communicating with the bore 101 in the portion 91. This construction allows a periphery of the balls to extend into the bore 101 and locate in a groove 102, which extends around releasable portion 93. When the sleeve 97 is in the position shown in FIG. 9, the balls prevent portion 93 from separating from the remainder of the device.

Circlip 103 extends around device 91 and fixes retaining sleeve 95, sleeve 97 and stop plate 92 to device 91.

The sleeve 97 is spring biased and has extended portion 104 and rests on pin 94 to maintain the configuration shown. Pin 94 has a circlip 94*a* to prevent pin from falling out of the device. Portion 104 may locate within recess 96 is shown in FIG. 10.

When the release block 30 travels down the chain, the flared end 110 of the block drives the pins 94 inwardly against the spring bias and sleeve 97 is released and is able to move upwardly as shown in FIG. 10. The balls 98 may then be moved outwardly as releasable portion 93 moves down. The balls are then received partially within an enlarged part 111 of a bore through the sleeve.

Sleeve 97 is prevented from moving further by plate 92. The portion 93 may be returned to the FIG. 9 position by moving the block 30 along the chain 12 away from the device 91.

The portion 93 is pushed into the bore 101 and the sleeve 97 is manually pulled downwardly against the spring 97*a* and then pins 94 return to the FIG. 9 position.

Sleeve 97 can be positioned on the chain 12 either way. (Flared end both sides).

Figure 11:
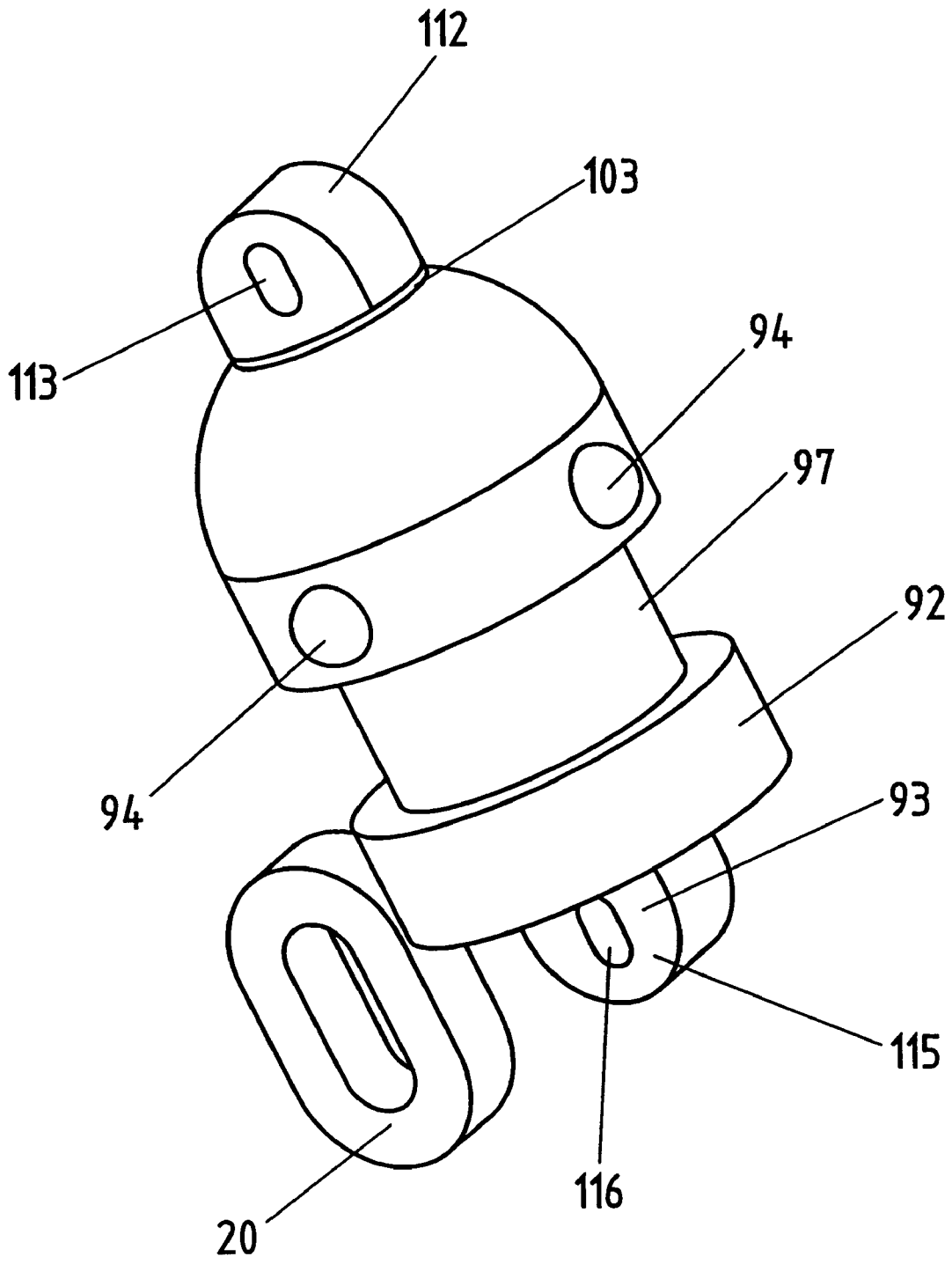
FIG. 11 shows a perspective view of the device of FIG. 9.

FIG. 11 shows a perspective view of the device 90. An eye 112 with an aperture 113 is provided at one end of portion 91 and the chain 12 may be secured to this eye.

The plate 92 has a chain link welded for receiving the chain 20 or as in FIGS. 9 and 10 extended portion 92 welded to 92 which contains link 20 and portion 93 has an eye 115 with an aperture 116 to which the link 26 is attached.

Figure 12:
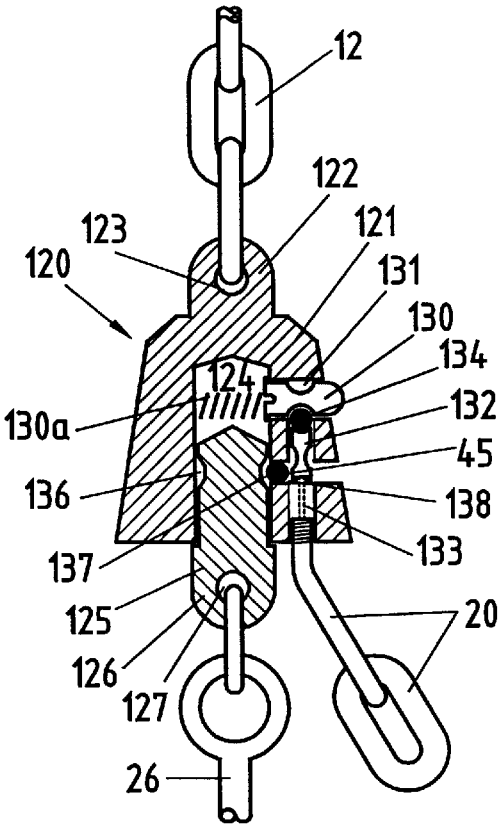
FIG. 12 shows detail of an anchor retrieving/connection device according to another embodiment of the invention.
Figure 13:
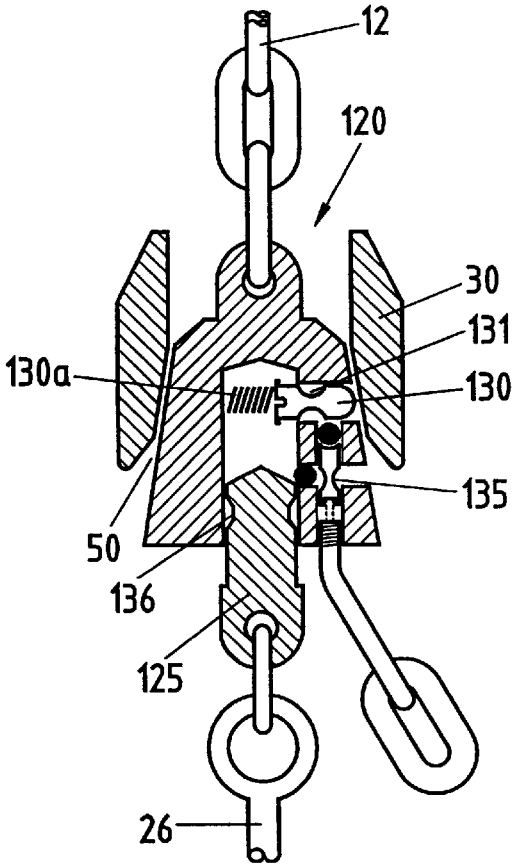
FIG. 13 shows a view of the device of FIG. 12 in its release position.
Figure 14:
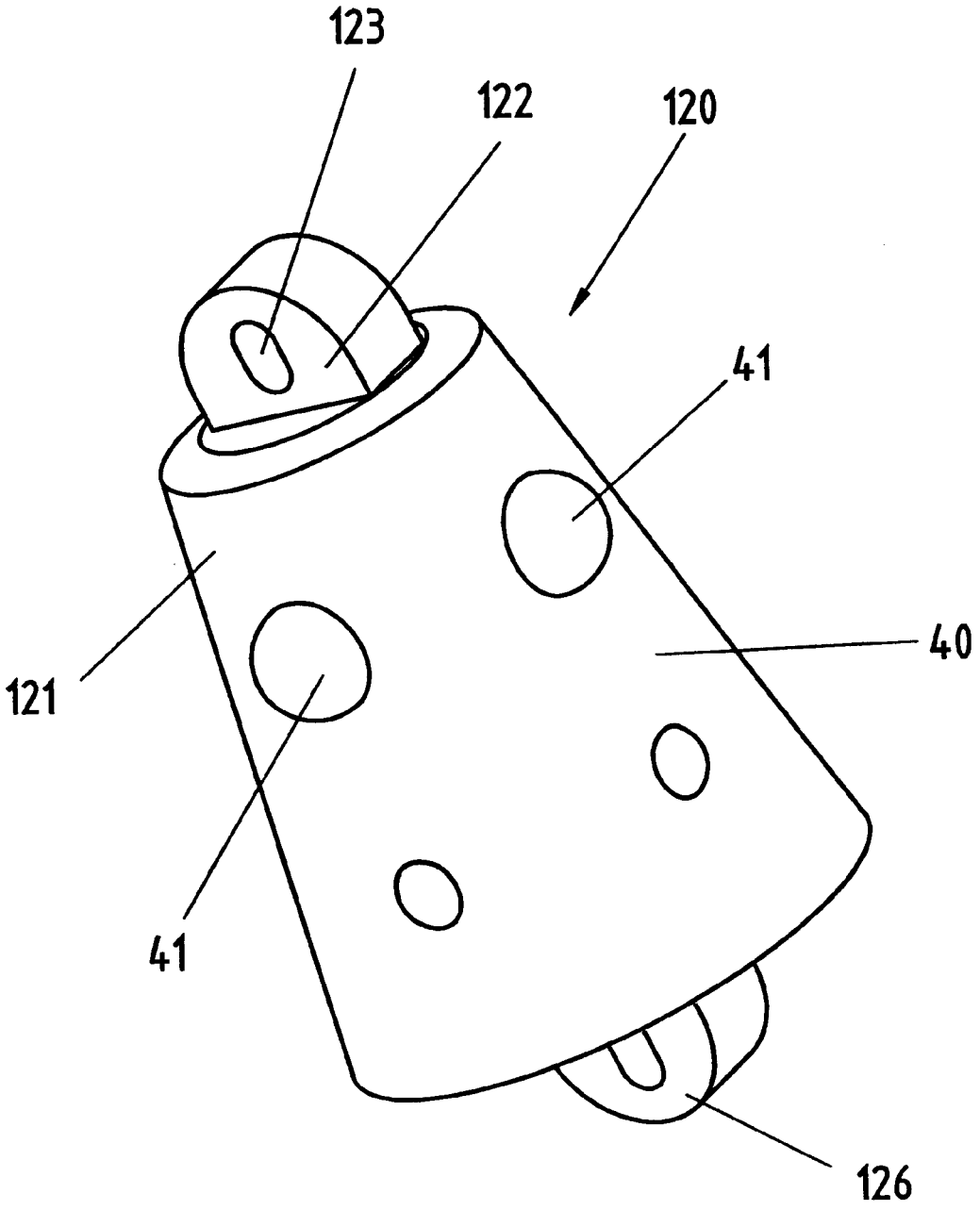
FIG. 14 shows a perspective view of the device of FIG. 12.

FIGS. 12, 13 and 14 show an alternative device 120. The device 120 has a locking portion 121 with an eye 122 having an aperture 123 to which the chain 12 is secured. The portion 121 has a bore 124 for receiving a releasable portion 125. Portion 125 has an eye 126 with an aperture 127 for receiving link 26. Chain 20 is connected to portion 121.

Three release pins 130 (only one of which is shown in FIGS. 12 and 13) are arranged around portion 121 and are spring biased by springs 130*a* to extend outwardly as shown in FIG. 12. Each pin 130 has a groove 131. A locking slide 132 is associated with each pin 130 and the slides are biased into the FIG. 12 position by a spring 133. A ball 134 is associated with each slide and is located between each pin 130 and the slide 132. Slide 132 has a reduced diameter intermediate portion 135 and portion 125 has a groove 136 extending around it. Retaining ball 137 is received within a passage 138 and projects into the bore 124 and into groove 136 to prevent portion 125 from separating from portion 121. The ball 137 is held in this position by the slide 132.

The release block 30 causes the pins 130 to be driven into the bore 124. This causes the respective balls 134 and the respective slides 132 to be moved downwardly. The balls 137 are then free to move out of the groove 136 and portion 125 may then separate from portion 121.

The portion 125 is reinserted into the bore 124 and then the block 30 is moved up the chain 12 so that the device may assume the FIG. 12 position.

When the block 30 is moved up the chain 12 the pins 130 return to the FIG. 12 position and the portion 125 may then be reinserted into and held within the bore 124.

What is claimed is:

1. An anchor connection and retrieving device adapted to be interposed between an anchor and one end of a main anchor line, the anchor having a shank, a crown and a plurality of tynes or flukes, the device having a locking assembly including a releasable portion, a locking portion relative to which the releasable portion is releasably coupled, a release member movable laterally between a first position allowing the releasable portion to be coupled to the locking portion and a second position in which the releasable portion may decouple from the locking portion, the locking portion being connected to the one end of the anchor line and a retrieving line connected to the locking portion and to the crown of the anchor, the releasable portion being coupled to the shank of the anchor, and a release block adapted for slidable travel along the anchor line and the locking portion and for directly engaging the release member to move the release member laterally into the locking portion to allow the releasable portion to decouple from the locking portion.

2. An anchor connection and retrieving device adapted to be interposed between an anchor and one end of a main anchor line, the anchor having a shank, a crown and tines or flukes, the device having a locking assembly including a releasable portion, a locking portion relative to which the releasable portion is releasably coupled, at least two release members movable laterally between a first position allowing the releasable portion to be coupled to the locking portion and a second position in which the releasable portion may decouple from the locking portion whereby both said release members need to be moved to the second position before the releasable portion can be decoupled from the locking portion, the locking portion being connected to the one end of the anchor line and a retrieving line connected to the locking portion and to the crown of the anchor, the releasable portion being coupled to the shank of the anchor, and a release block adapted for slidable travel along the anchor line and the locking portion and for directly engaging the release members to move the release members laterally into the locking portion to allow the releasable portion to decouple from the locking portion.

3. The anchor connection of claim 1 wherein the release block is tubular and has a flared end at one end and is adapted to receive the anchor line within it and travel along the anchor line.

4. The anchor connection of claim 3 wherein the release block consists of two halves hinged to each other and having a lock for locking the two halves relative to each other, the lock allowing the halves to be pivoted relative to each other when the lock is opened so that the anchor line may be positioned within the release block.

5. The anchor connection of claim 1 wherein the locking portion has a transversely extending bore for receiving the release member.

6. The anchor connection of claim 5 including a spring biased pin for biasing the release member into its first position.

7. The anchor connection of claim 6 having a recess in the locking portion in which the releasable portion is normally received, the releasable portion carrying the spring biased pin whereby when the release member is moved laterally by the release block, the spring biased pin is moved into the releasable portion thereby allowing the releasable portion to separate from the locking portion.

8. The anchor connection of claim 7 wherein the locking portion has a tapered shoulder leading into the recess and the releasable portion has a cooperating tapered shoulder on a free end thereof.

9. The anchor connection of claim 2 wherein the release block is tubular and has a flared end at one end and is adapted to receive the anchor line within it and travel along the anchor line.

10. The anchor connection of claim 9 wherein the release block consists of two halves hinged to each other and having a lock for locking the two halves relative to each other, the lock allowing the halves to be pivoted relative to each other when the lock is opened so that the anchor line may be positioned within the release block.

11. The anchor connection of claim 2 wherein the locking portion has a transversely extending bore for receiving one of the release members.

12. The anchor connection of claim 11 wherein the releasable portion has a transversely extending bore for receiving another of the release members, the release member received by the releasable portion being biased to extend outwardly from sides of the releasable portion such that one end abuts the one release member.

13. The anchor connection of claim 12 wherein the other release member consists of two parts with a spring extending between them for biasing the parts in opposite directions so that they extend outwardly of the bore in the releasable portion when it is decoupled from the locking member.

14. The anchor connection of claim 13 having a recess in the locking portion in which the releasable portion is normally received whereby when the release members are moved laterally by the release block the releasable portion is allowed to separate from the locking portion.

15. The anchor connection of claim 14 wherein the locking portion has a tapered shoulder leading into the recess and the releasable portion has a cooperating tapered shoulder on a free end thereof.

16. The anchor connection of claim 2 including three radially spaced said release members normally extending outwardly from the locking portion, each said release member being biased to the first position and having a recess.

17. The anchor connection of claim 16 including a retainer biased towards the release members for holding the release members in the second position when the release block causes the release members to move to the second position.

18. The anchor connection of claim 17 wherein the retainer is a sleeve having an extended portion for engagement in the recess of the release members.

19. The anchor connection of claim 18 wherein the releasable portion has a recess and locking members located between the locking portion and the releasable portion normally holding the releasable portion relative to the locking portion whereby when the extended portion of the retainer sleeve engages the recess in the release member, the locking members may move out of the recess in the releasable portion to allow the releasable portion to be decoupled from the locking portion.

20. The anchor connection of claim 19 wherein the locking members are locking balls.

21. The anchor connection of claim 16 wherein the releasable portion has a recess for receiving locking members for normally connecting the releasable portion to the locking portion when the release members are in the first position.

22. The anchor connection of claim 21 including retainers for maintaining the locking members in engagement with the releasable portion and being biased towards the release members.

23. The anchor connection of claim 22 wherein the release members have recesses and the retainers comprise a spring biased slide and a retaining ball carried by the slide for engagement with the release members.

24. The anchor connection of claim 23 wherein the spring biased slide has a recess for receiving the locking members to allow the releasable portion to be decoupled from the locking portion.

* * * * *